United States Patent [19]

Alley et al.

[11] Patent Number: 4,510,772

[45] Date of Patent: Apr. 16, 1985

[54] HOLLOW EARRING POST

[75] Inventors: Philip J. Alley; Thomas R. Ireland, both of Warwick, R.I.

[73] Assignee: Hallmark Findings, Inc., Warwick, R.I.

[21] Appl. No.: 476,051

[22] Filed: Mar. 17, 1983

[51] Int. Cl.[3] ..... A44C 7/00

[52] U.S. Cl. ..... 63/12; 428/580

[58] Field of Search ..... 63/12, 13, 26, 27; 428/577, 578, 579, 580

[56] References Cited

U.S. PATENT DOCUMENTS

| | | | |
|---|---|---|---|
| 133,778 | 12/1872 | Jenkins | 63/26 |
| 733,263 | 7/1903 | Nordt | 63/27 |
| 1,713,285 | 5/1929 | Juergens | 63/13 |
| 4,307,582 | 12/1981 | Mancini | 63/12 |
| 4,383,002 | 5/1983 | Manolescu | 428/580 |

*Primary Examiner*—F. Barry Shay

*Attorney, Agent, or Firm*—Lewis H. Eslinger

[57] ABSTRACT

A metal post for a pierced earring is formed of an elongate hollow, tubular member having an open end and a closed rounded end. A disk shaped member having an upper face and a centrally located hole is placed onto the open end portion of the post. The disk further has solder flush applied to an upper face which is directed toward the open end of the post. An ornamental member, provided with a socket, is subsequently placed onto the open end of the post and positioned against the disk. Heat is subsequently applied to the solder flush to effect suitable joining of the post, disk and ornamental member to each other.

8 Claims, 4 Drawing Figures

FIG. 1
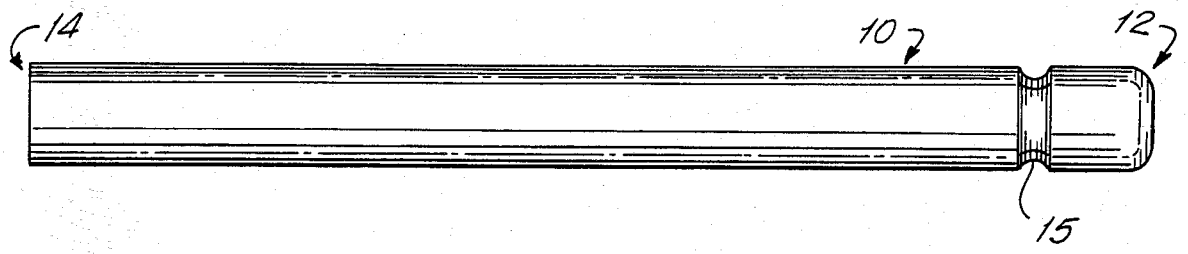
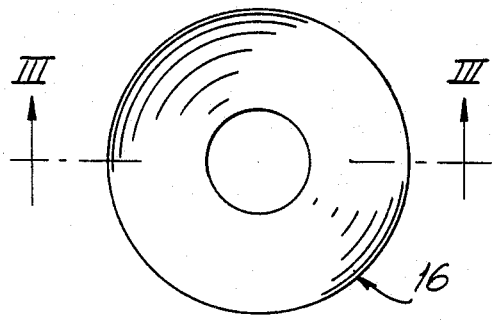
FIG. 2
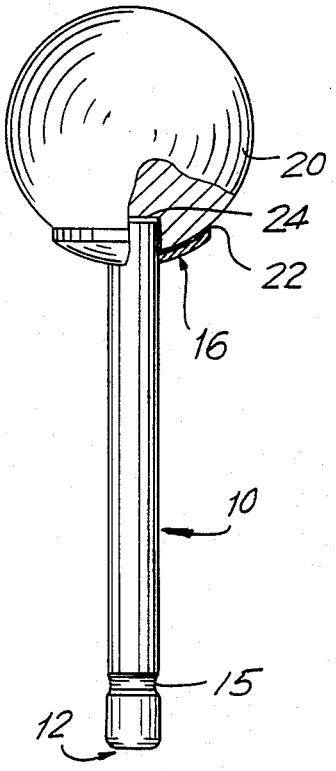
FIG. 4
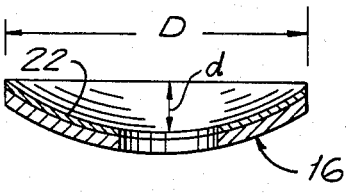
FIG. 3

HOLLOW EARRING POST

BACKGROUND OF THE INVENTION

1. Field of the Invention

The present invention relates generally to pierced earrings and, more particularly, pertains to a configuration for a hollow earring post and a pierced earring which incorporates the novel post.

2. Discussion of the Prior Art

Earrings, and particularly pierced earrings, have been in wide use throughout the world for numerous generations. Typically an earring is comprised of an ornamental portion or member which rests, and is simultaneously displayed, on the front or outer surface of the wearer's earlobe. The ornamental portion is attached to a post member which extends completely through the pierced opening in the earlobe in such a manner as to extend therebehind to accept a clasping member which grasps the post to prevent removal of the earring from the earlobe.

As is also well known, earring posts of the type previously described are normally constructed of precious metal, such as silver or gold, in order to regulate and minimize the danger of infection or contamination to the wearer. As a consequence of the public's desire to wear earrings made from precious metals and in view of the rising costs of these materials, it has become highly desirable to minimize the amount of precious metal used in constructing the portion of the earring which is not being displayed, namely, the metal earring post.

Generally, in the past, earring posts have been made with a solid cylindrical configuration having a small diameter, for example, of approximately 0.027 inches. Recently, and as described in U.S. Pat. No. 4,307,582, to Mancini, it has been proposed to manufacture hollow earring posts of a slightly increased, but still small diameter of 0.035 inches. The tubular or hollow post disclosed therein has a layer of solder flush over its entire inner surface to presumably provide a fastening means for attaching an ornamental member thereto. As is further disclosed therein, the post has an integrally formed flange formed at the open end thereof which inherently provides a surface to which an ornamental member can be attached.

Numerous disadvantages exist with this type of post configuration. Firstly, the manufacturing process required to form such an integral flange, at a right angle to the post, inherently requires the use of an extremely soft alloy for the post. Such an alloy, it has been found, is too soft to be successfully used in such an earring configuration, and eventually leads to the breaking of the post and the possible loss of the earring and damage to the wearer's earlobe. Secondly, Mancini discloses a post with an integrally formed flange to which an ornamental member is subsequently attached. However, no effective means is provided on the post for centering the ornamental member in respect thereto. Rather, assembling equipment has to be provided with centering devices so that the ornamental member is not attached to the post in an off-center position which would cause the display of the ornamental member to be awkward and displeasing to the wearer.

OBJECTS AND SUMMARY OF THE INVENTION

It is an object of the present invention to provide a post for pierced earrings which effectively overcomes the aforementioned problems associated with the prior art. Particularly, the present invention provides a hollow post configuration which can be more easily, and inexpensively manufactured.

Another object of the present invention is to provide an improved attachment of an ornamental member to the hollow post to effectively provide sufficient strength to the earring so formed.

Still another object of the present invention is to provide a hollow post, as aforesaid, which will effectively decrease the amount of material required to form an earring therewith for decreasing the overall cost thereof.

A further object of the present invention is to simplify the assembling of an earring provided with a hollow post.

Still, another object of the present invention is to provide a hollow post which is formed of an alloy with sufficient strength and hardness to withstand the stresses to which the post is subjected while being worn in the earlobe.

Yet another object is to provide a post with a means for easily centering an ornamental member thereon.

In accordance with an aspect of the present invention, a hollow post is provided in the form of an elongated hollow, tubular member having a closed rounded end with an circumferential groove integrally formed exteriorally thereof and in spaced relation thereto, and an open end at the other end thereof. A disk has a control opening which receives the open end portion of the post. A solder-flush is applied to the face of the disk directed toward the open end of the post. In a pierced earring configuration, an ornamental member, for example, in the form of a gold or other metal ball, has a socket or base which receives the open end portion of the post. Upon subsequent heating, the layer of solder-flush is melted to flow between the disk, post and ornamental member to create highly strong and sufficient bonds therebetween.

BRIEF DESCRIPTION OF THE DRAWINGS

The foregoing, and other objects, advantages and characterizing features of the invention, will become more readily apparent from the following detailed description of a preferred embodiment thereof, taken in conjunction with the accompanying drawings wherein like reference numerals denote similar parts throughout the various views:

FIG. 1 is a side elevational view of a hollow, tubular metal post according to an embodiment of the present invention, and which is shown on an enlarged scale;

FIG. 2 is a plan view of a disk-shaped member which is to be assembled on the post of FIG. 1 according to the present invention;

FIG. 3 is a cross-sectional view taken along the line III—III on FIG. 2; and FIG. 4 is a side elevational view, partly broken away and in section, of an earring assembled from the elements shown in FIGS. 1–3 in accordance with the teachings of the present invention, but which is shown on a smaller scale.

DESCRIPTION OF THE PREFERRED EMBODIMENT

Referring in detail to the drawings, a post 10 having a hollow tubular construction is shown on FIG. 1 to have a closed rounded end 12 and an opposite end 14, which can be open, as shown, or closed if considered desirable. The post 10 itself can be made of any precious metal but is typically formed from gold or silver alloy. The tubular post 10 further has an annular or circumferential groove 15 exteriorly formed thereabout and positioned in spaced relation to the closed rounded end 12 of the post 10. This groove 15 is well known in the art and is provided to receive a clamping member or clasp (not shown) which grips the post as it extends behind the wearer's earlobe. A disk 16 is shown in FIGS. 2 and 3 to be desirably concave-convex. A hole 18 is provided of the center of disk 16 so that the post 10 can be received in and project therethrough. Typically, a press fit connection can be initially made between the post 10 and disk 16. In an example of an earring according to this invention comprised of post 10, disk 16 and an ornamental member 20 in the form of a so-called 4 mm. one hole bead or ball, disk 16 may desirably have a diameter $D=0.1$ inch and a depth of curvature $d=0.026$ inch. However, it is to be realized that these dimensions of disk 16 can be suitably changed depending upon the size, shape and style of the particular earring. For instance, if the ornamental member 20 has a squared-off or flat base, disk 16 would be flat so as to matingly engage the ornamental member's base. Obviously, such other shapes for the ornamental member 20 and disk 16 are hence easily contemplated and are within the scope of the present invention. In all cases, a layer of solder flush 22 is applied to disk 16 on the upper face of the disk which is directed toward the open end 14 of post 10.

FIG. 4 shows a completely assembled earring according to the teachings of the present invention. Post 10 initially has disk 16 fitted over the open end 14 as described above. An ornamental member 20 with an opening or socket 24 having a diameter slightly larger than the diameter of post 10, is subsequently placed over and onto the open end 14 of post 10 so as to seat against disk 16. By centrally positioning the socket 24 in ornamental member 20 the latter is easily and effectively centered on post 10. Subsequently, the solder flush 22 is heated, by any well known heating means (not shown), and the solder flush 22 is consequently caused to flow between post 10, disk 16 and ornamental member 20 for securing such elements to each other. In this manner, an earring having a strong bond between post 10 and ornament 20 is provided.

Although a preferred embodiment of the invention has been described and illustrated in detail herein, it should be realized that the invention is not limited to that particular embodiment, and that modifications and variations may be effected therein by one skilled in the art without departing from the spirit and scope of this invention as defined in the appended claims.

What is claimed is:

1. A metal post for a pierced earring produced by the steps of providing an elongated hollow, tubular member having a closed rounded end; providing a disk shaped member having an upper face and a centrally positioned hole for receiving an end portion of said tubular member remote from said closed rounded end; coating said disk shaped member with a layer of solder flush on said upper face; positioning said remote end portion in said hole; and heating and subsequently melting said solder flush so that said disk shaped member is fastened thereby to said hollow tubular member.

2. A metal post as in claim 1 in which said tubular member has a circumferential groove exteriorally formed on said tubular member and positioned in spaced relation to said rounded end.

3. A metal post as in claim 1, in which said tubular member and disk shaped member are comprised of a precious metal.

4. A metal post as in claim 1; in which said disk shaped member is spaced from the end of said tubular member remote from said rounded end so that a projecting end portion of said tubular member extends from said disk shaped member.

5. A pierced earring produced by the steps of providing an elongated hollow, tubular member having a closed rounded end; providing a disk shaped member having an upper face and a centrally positioned hole for receiving an end portion of said tubular member remote from said rounded end; providing an ornamental member having a socket formed to receive said remote end portion of said tubular member with said ornamental member seating against said disk shaped member; coating said disk shaped member with a layer of solder flush on the face directed toward said ornamental member; positioning said remote end portion of said tubular member in said hole; positioning said ornamental member such that said remote end portion is within said socket and said ornamental member is seated against said face of said disk shaped member; and heating and subsequently melting said solder flush so that said ornamental member, said tubular member and said disk shaped member are secured to each other thereby.

6. A pierced earring as in claim 5, said tubular member having a circumferential groove exteriorally formed thereon and positioned in spaced relation to said rounded end.

7. A pierced earring as in claim 5, in which said ornamental member is comprised of precious metal.

8. A pierced earring as in claim 5, in which said tubular member, said disk shaped member and said ornamental member are formed of a precious metal.

* * * * *